United States Patent [19]

Young

[11] 4,010,944

[45] Mar. 8, 1977

[54] BLANK FEEDING DEVICE HAVING AN ADJUSTABLE AND AUTOMATIC POSITIONING BACKSTOP MEANS

[75] Inventor: Donald Warren Young, Jarrettsville, Md.

[73] Assignee: Koppers Company, Inc., Pittsburgh, Pa.

[22] Filed: June 16, 1975

[21] Appl. No.: 587,288

[52] U.S. Cl. ..... 271/99; 271/134; 271/144; 271/166; 271/171

[51] Int. Cl.[2] ..... B65H 1/06; B65H 3/08

[58] Field of Search ..... 271/99, 132, 134, 144, 271/166, 171, 102, 184, 225, 142, 135, 133, 165, 224; 214/8.5 D, 8.5 F

[56] References Cited

UNITED STATES PATENTS

| | | | |
|---|---|---|---|
| 773,939 | 11/1904 | Johnson | 271/166 X |
| 1,643,646 | 9/1927 | Swift | 271/134 |
| 2,498,061 | 2/1950 | Apgar | 271/184 |
| 3,226,108 | 12/1965 | Bishop | 271/99 |
| 3,481,598 | 12/1969 | Lopez | 271/184 |
| 3,726,454 | 4/1973 | Robbins | 271/166 X |
| 3,866,641 | 12/1958 | Cote | 271/134 |
| 3,949,980 | 4/1976 | Hartka | 271/134 |

*Primary Examiner*—Johnny D. Cherry
*Assistant Examiner*—Bruce H. Stoner, Jr.
*Attorney, Agent, or Firm*—Oscar B. Brumback

[57] ABSTRACT

A blank feeding device for feeding successive bottom blanks from a stack of blanks into adjacent processing machinery includes a feed table for supporting the stack of blanks thereon; a gate spaced above the feed table and defining an opening therebetween through which the bottom blanks are advanced into adjacent processing machinery; a reciprocating suction feeder beneath the stack for applying suction pressure to the bottom blank during the forward stroke of the suction feeder for advancing the bottom blank through the opening; and an adjustable backstop including a manually pivotable portion in contact with the trailing edge of the blanks in the stack for maintaining a portion of the weight of the stack off the bottom most blank and automatically positionable along the feed table to accommodate different size blanks.

11 Claims, 6 Drawing Figures

FIG. 5
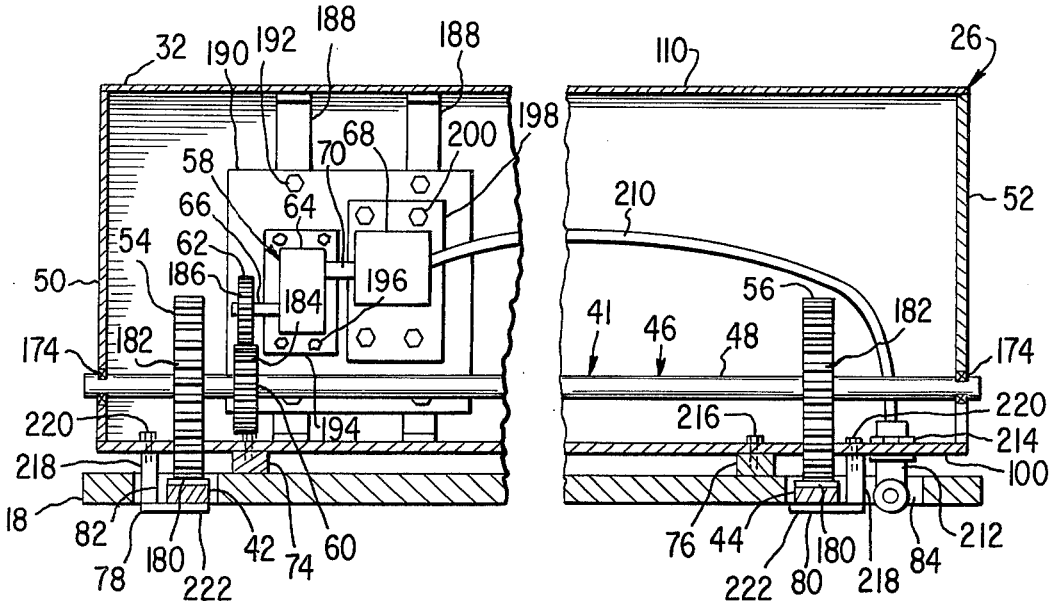
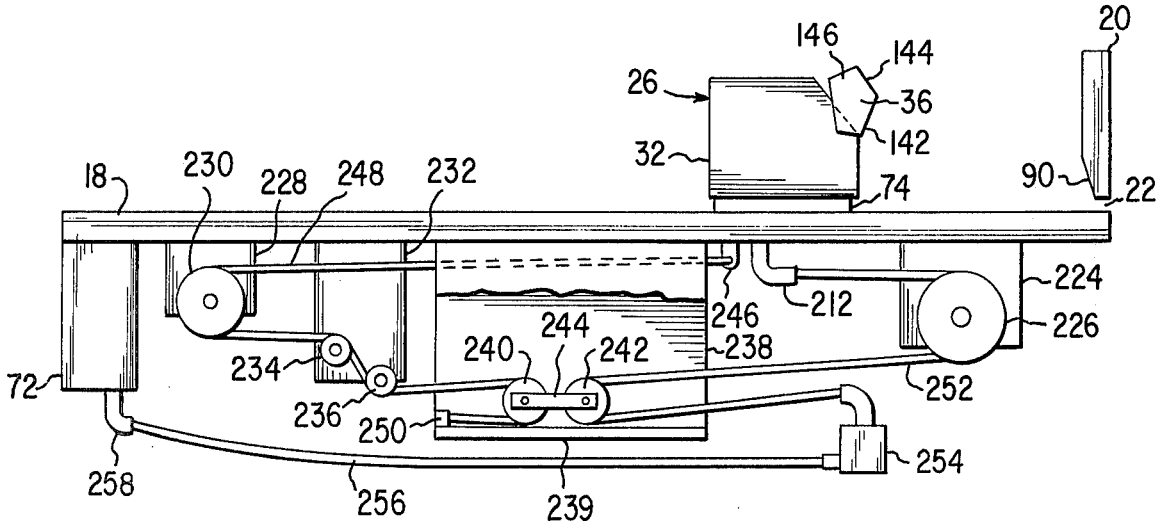
FIG. 6

BLANK FEEDING DEVICE HAVING AN ADJUSTABLE AND AUTOMATIC POSITIONING BACKSTOP MEANS

BACKGROUND OF THE INVENTION

1. Field of the Invention

This invention relates to sheet feeding separators having a pneumatic bottom feed and more particularly to blank feeding machines having an adjustable backstop means for maintaining a portion of the weight of the stack off the bottom sheet and providing a means for automatically positioning the backstop means along the support table for accommodating different size stacks on the support table.

2. Description of the Prior Art

Blank feeders for feeding the bottom blank a stack of paperboard blanks are well known in the art and are used for feeding the blanks into adjacent processing machinery.

There are basically two types of blank feeders used in industry today. One type of feeder utilizes a kicker bar which reciprocates back and forth along the feed table picking up the bottom blank on its rearward position and then pushing the bottom blank through an opening in a gate and into the adjacent processing apparatus. The use of a reciprocating feed bar by itself has inherent disadvantages. In a typical blank feeding machine there is a gate that is spaced above the feed table approximately the same as the thickness of the bottom blank to be fed. The stack of blanks are placed upon the feed table so that the stack of blanks is resting against a front stop which forms the gate. The bottom blank is then fed through the opening by the reciprocating feed bar. This type of feeder works well when all the blanks of the stack are flat. However, the blanks that are processed in the corrugating paperboard industry are not always flat but are warped. When a warped blank becomes the bottommost blank of the stack it is unable to be fed through the opening in the gate by the reciprocating feed bar. This then necessitates a shut down of the machinery until the warped blank can be removed from the machinery.

To pull the leading edge of the warped bottom blank flat against the feed table so the kicker bar can feed the warped blank through the opening in the gate the corrugating industry developed suction feeders. One type of suction feeder utilizes a stationery suction chamber such as shown in Ward et al U.S. Pat. No. 3,588,095 and Thayer U.S. Pat. No. 3,754,752. Such suction feeders are designed to hold the bottom blank against the support table. The reciprocating feed bar then engages the trailing edge of the bottom blank and moves it through the opening in the gate and into the processing apparatus. These suction feeders utilize the reciprocating feed bar to move the bottom blank through the gate mechanism and as previously explained were developed to eliminate the problem of feeding warped blanks which prevent them from passing through the opening in the gate mechanism. These suction feeders generally do their job very well. The suction chamber pulls the warped botttom blank against the support table and the suction pressure is strong enough to flatten the warped blank and allow the feeder bar to engage the trailing edge of the blank and move it through the gap in the gate mechanism.

Although the reciprocating feed bar type suction feeder has the above mentioned advantage, it does have a number of disadvantages. First, the suction pressure in the suction chamber must be continuously applied so that the warped blank will stay flat during movement through the opening in the gate mechanism. This continuous suction pressure creates friction between the blank and support table which the feeder bar must overcome to advance the blank. The feeder bar pushes against the trailing edge of the blank and tends to bend or deform the trailing edge thus damaging the product.

Another disadvantage of the reciprocating feed bar type feeder whether used singularly or in combination with the stationery suction chamber is that the feeder bar reciprocates rapidly in the area where the machine operator stands at the rear of the stack. As he loads the stack onto the support table, his hands are in close proximity to the feeder bar. Should the operator be careless or make a mistake, his hands may contact the moving feeder bar and injure his hands.

A second type of suction feeder is shown in E. L. Bishop U.S. Pat. No. 2,331,533 and T. D. Bishop U.S. Pat. No. 3,226,108, which is an improvement over the E. L. Bishop patent. In this type of suction feeder the suction box itself reciprocates along the plane of the feed table eliminating the need for a feeder bar and consequently the disadvantages associated with the feeder bar. Suction in the box draws the bottom blanks downward into flat contact with the top of the suction box. The suction box moves the blanks forward until its leading edges are gripped by a pair of pull rollers beyond the gate which pull the blank into the processing machinery. When the pull rolls grip the blank the vacuum in the suction box is released to atmosphere which releases the blank from the suction box and allows easy pulling of the blank by the pull rolls. The suction box then moves rearward until it is below the next bottom blank at which time the vacuum is reapplied to the suction box to feed the next blank.

On all three of the above mentioned type feeders, the operator places a stack of box blanks on the support table so that the leading edges of the box blank are in contact with the gate mechanism. In addition, it is customary to have a backstop means which is movable along the support table and which rests against the trailing edge of the box blanks. Thus, when the backstop is in contact with the trailing edge of the blanks in the stack of blanks, it will maintain the leading edge of the box blanks in contact with the gate mechanism. This is to insure that the box blanks that are placed upon the support table are not cocked sideways and thus when fed through the opening in the gate mechanism would not enter the processing machinery at the correct angle and thus cause the processing machinery to stop or produce a box blank which is not processed correctly.

A disadvantage of the above type feeders is that a stack of blanks are placed upon the support table by the operator and this stack of blanks places a lot of weight upon the bottom blank. In those type feeders that utilize a reciprocating feeder bar the feeder bar contacts the trailing edge of the bottom blank and moves the bottom blank through the opening in the gate mechanism. When the weight of the stack is on the bottom blank, there is a great amount of friction between the bottom blank and the blank above it and between the bottom blank and the support table. Thus, the reciprocating feed bar must overcome the weight of the stack above it and the various frictional forces before moving the bottom blank through the opening. In many instances, the feed bar is unable to overcome the weight of the stack above it, and consequently it damages the trailing edge of the bottommost blank.

The above disadvantage is also inherent in the suction type feeders that utilize both the stationery suction chamber and the reciprocating feeder bar. In fact, the disadvantages are even greater in this type of feeder because in addition to the weight of the stack of blanks on the bottommost blank the stationery suction chambers also cause additional friction on the bottommost blank. The above disadvantage also presents problems for the reciprocating suction chamber in that the reciprocating suction chamber must create a sufficient amount of suction to overcome the weight of the stack on the bottommost blank and thus the friction between the bottom blank and the blank just above it. This necessitates large machinery to create the great amount of suction pressure that is needed to move the bottommost blank through the opening in the gate.

Another disadvantage of the above type blank feeders is that different width blanks are stacked on the support table and thus the backstop must be movable along the support table to accommodate the different size blanks that form the stacks on the support table. Conventionally, the backstop is moved manually by the machine operator each time different size blanks are to be run. When a different size blank is to be run, the operator manually unlocks the backstop from the support table and moves the backstop forward or rearward to accommodate the proper size blanks. The operator then relocks the backstop in place on the support table and places a new stack of blanks thereon.

Hottendorf U.S. Pat. No. 3,804,402 has overcome the disadvantage of manually moving the backstop when associated with a kicker bar type feeder. Hottendorf utilizes a pair of rotatable shafts each connected to the backstop and the kicker bar respectively. The pair of rotating shafts are interconnected by gearing which is connected to a conventional motor for rotating the two rotatable shafts simultaneously. When it is desired to adjust the backstop and the kicker bar, the operator energizes the motor which simultaneously turns the pair of shafts moving the backstop and kicker bar forward and backward along the support table until the desired position is reached that will accommodate the desired size of blanks. However, Hottendorf still has the disadvantage of having to overcome the entire weight of the stack upon the support table when the kicker bar tries to move the bottom blank through the opening in the gate mechanism. Thus the disadvantage of the kicker bar is still inherent in Hottendorf. In addition, the backstop cannot be moved independently of the kicker bar.

SUMMARY OF THE INVENTION

Accordingly, an object of the present invention is to provide a blank feeding device that will overcome the aforementioned disadvantages and others. Thus, this invention provides a reciprocating suction feeder beneath the bottommost blank of a stack of blanks for forcing a warped blank flat against the feed table so that it may be fed through an opening in a gate mechanism. In addition, this invention eliminates the need and disadvantages inherent in the reciprocating feed bar by the use of the reciprocating suction feeder. In addition, this invention utilizes an adjustable backstop means for keeping a portion of the weight of the stack of blanks off the bottommost blank so that a minimum amount of suction pressure need be applied by the suction feeder to feed the bottommost blank through the opening in the gate mechanism. Further, this invention provides for an automatic positionable backstop means along the length of the feed table so the operator can attend to his other duties rather than taking the time to manually change the position of the backstop.

The apparatus for accomplishing the above objects is a blank feeding machine for feeding successive bottom blanks from a stack of blanks into adjacent processing machinery comprising: support means for supporting the stack of blanks thereon; gate means spaced above said support means and defining an opening therebetween through which the bottom blanks are advanced into adjacent processing machinery; reciprocating suction feed means beneath the stack for applying suction pressure to the bottom blanks during the forward stroke thereof for advancing the bottom blank through the opening; and an adjustable backstop in contact with the trailing edge of the blanks in the stack for maintaining a portion of the weight of the stack off the bottommost blank and automatically positionable along the support means to accommodate different size blanks.

The above and further objects and novel features of the invention will appear more fully in the following detailed description when the same is read in connection with the accompanying drawings. It is to be expressly understood, however, that the drawings are not intended as a definition of the invention, but are for the purpose of illustration only.

BRIEF DESCRIPTION OF THE DRAWINGS

In the drawings, wherein like parts are marked alike:

FIG. 5 is a front view in cross section of the backstop means of FIG. 1 showing the axle means for propelling the backstop means along the support means; and FIG. 6 is a schematic side view of the blank feeding machine of FIG. 1 showing a means of allowing the backstop means to traverse the length of the support means while insuring that the electrical cable to the drive means is kept away from the reciprocating machinery.

DESCRIPTION OF THE PREFERRED EMBODIMENT

Figure 1:
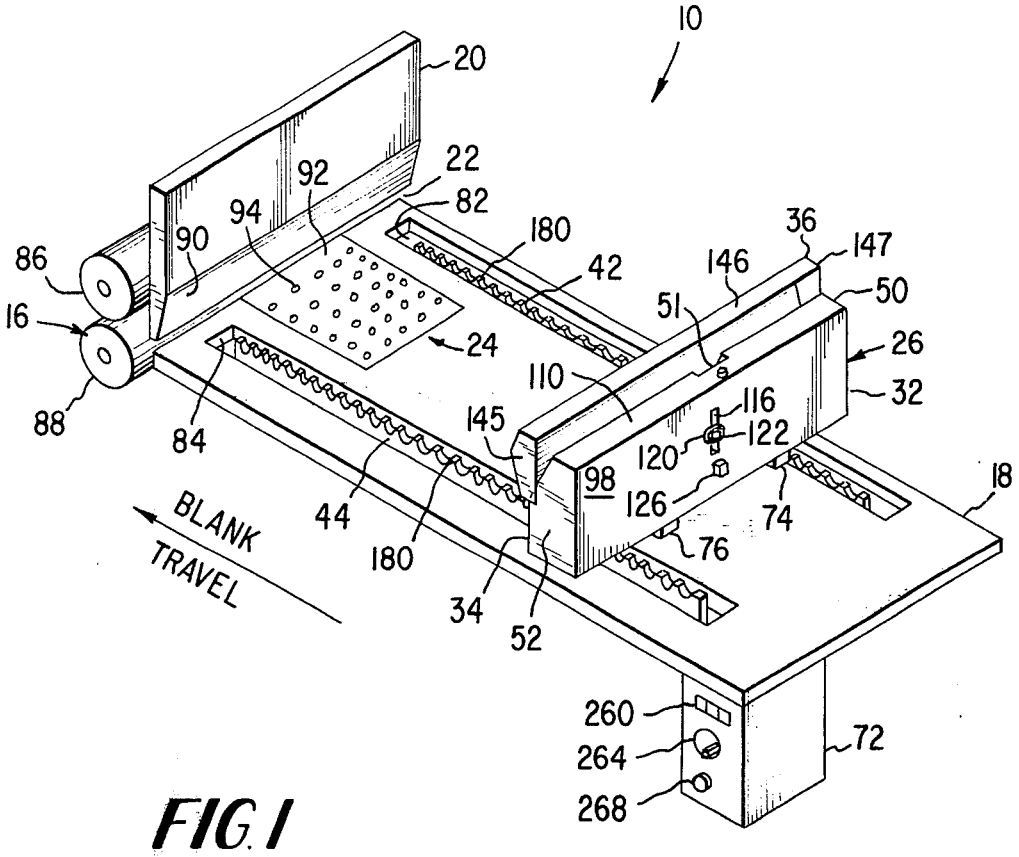
FIG. 1 is a perspective view of the blank feeding machine of the present invention looking downward and to the left.

Referring to FIG. 1, the invention generally comprises a blank feeding machine, denoted generally by numeral 10, for feeding successive bottom blanks 12 (FIG. 2) from a stack of blanks 14 (FIG. 2) into adjacent processing machinery, denoted generally be numeral 16. The blank feeding machine 10 generally comprises a support means 18 for supporting a stack of blanks 14 thereon. A gate means 20 is spaced above support means 18 defining an opening 22 therebetween through which bottom blank 12 is advanced into adjacent processing machinery 16. A reciprocating suction feed means, denoted generally by numeral 24, reciprocates beneath the stack of blanks 14 for applying suction pressure to bottom blank 12 during the forward stroke thereof for advancing bottom blank 12 through opening 22. An adjustable backstop means, denoted generally by numeral 26, is in contact with the trailing edge 28 of the stack of blanks 14 for keeping a portion of the weight of the stack of blanks 14 off bottom blank 12. In addition, adjustable backstop means 26 is automatically positionable along support means 18 to accommodate different size blanks.

Figure 2:
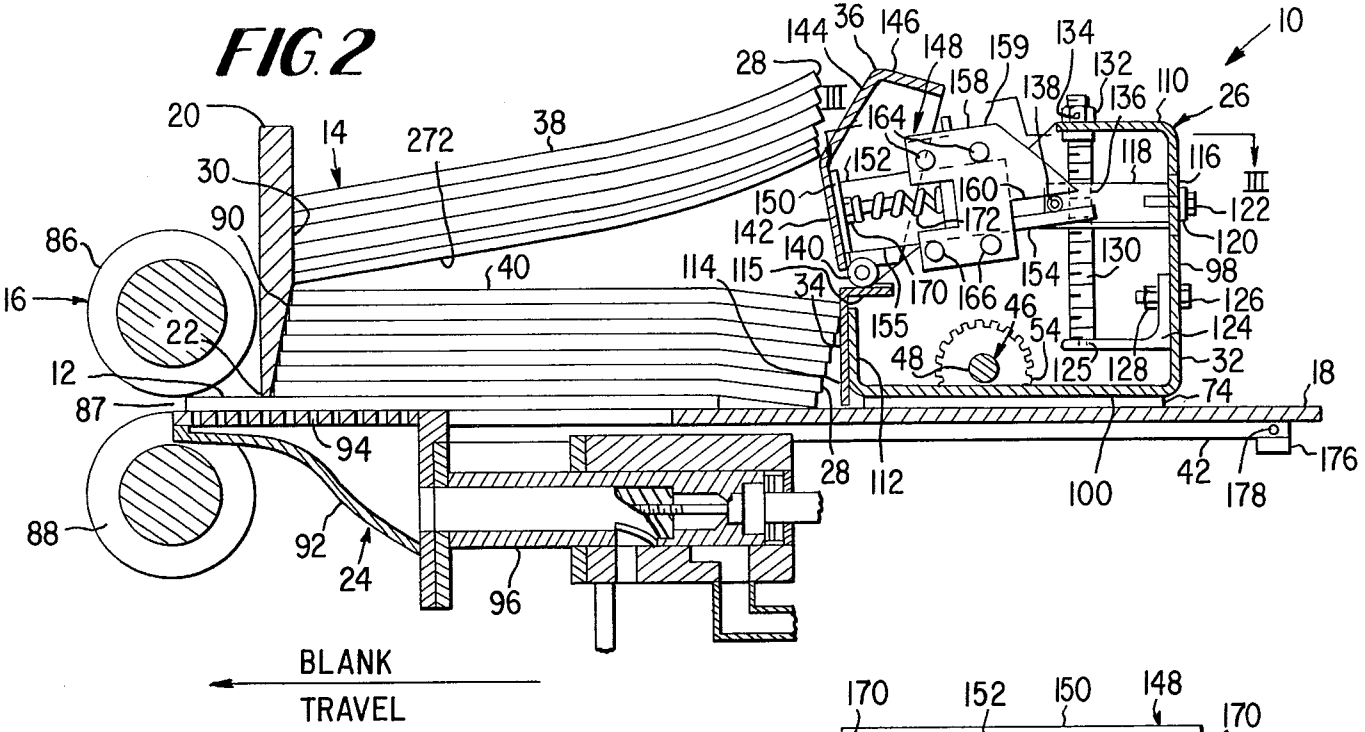
FIG. 2 is a side view in cross section of the blank feeding machine of FIG. 1 showing the adjustable and automatically positionable backstop means, the stack of blanks upon the support table with a portion of the weight of the stack of blanks removed therefrom, and the reciprocating suction feeder.

More particularly, and referring to FIGS. 1 and 2, blank feeding machine 10 includes a support means 18 which supports a stack of blanks 14 thereon. Support means 18 is preferably a support table constructed in the conventional manner. Support means 18 is supported by support structure (not shown) in the well known manner. Support table 18 includes a pair of spaced slots 82 and 84 running the length thereof and straddling the reciprocating suction feed means 24 as shown in FIG. 1. The use of slots 82 and 84 in support means 18 will be described later.

Blank feeding machine 10 further includes a conventional gate means 20 which is spaced above support means 18 forming an opening 22 therebetween. Gate means 20 is supported above support table 18 in the conventional and well known manner. Gate means 20 is spaced above support means 18 so that opening 22 between the bottom of gate means 20 and support means 18 is substantially the same thickness as bottom blank 12 so that bottom blank 12 may be moved through opening 22. Preferably, gate means 20 includes a tapered face 90 tapering from substantially the center of gate means 20 downward and inward to the bottom of gate means 20. The reason for sloped surface 90 will be explained in detail later.

A reciprocating suction feed means 24 is associated with blank feeding machine 10 and in particular with support means 18 for applying suction pressure to bottom blank 12 on the forward stroke of suction feed means 24 thus feeding bottom blank 12 through opening 22 and into adjacent processing machine 16. The adjacent processng machinery includes a pair of pull rolls 86 and 88 spaced above one another forming gap 87 therebetween which is in alignment with opening 22. During the operation of the machinery pull rolls 86 and 88 are rotating. When suction feed means 24 propels bottom blank 12 through opening 22, pull rolls 86 and 88 grab hold of the end of bottom blank 12 pulling bottom blank 12 through pull rolls 86 and 88. The adjacent processing machinery can be any type of conventional processing machinery such as, for example, for slitting, scoring, folding, or printing bottom blank 12.

Suction feed means 24 includes a suction box 92 which is situated beneath bottom blank 12 and reciprocates in a space provided in support means 18. Suction box 92 includes a plurality of suction openings 94 extending through the top of suction box 92 so that suction may be applied through suction openings 94 to bottom blank 12. Suction feed means 24 further includes a reciprocating piston 96 which reciprocates forward and backward for propelling suction box 92 and consequently bottom blank 12 between pull rolls 86 and 88 on the forward stroke and then for moving suction box 92 in the rearward direction beneath the next bottom blank 12. A full and detailed description of suction means 24 and the operation thereof is fully described in the patent application of Frederick Reinhold Kuehn, Ser. No. 451,566, now U.S. Pat. No. 3,904,190, filed Mar. 15, 1974 entitled "Apparatus for Feeding Paperboard Blanks" and assigned to the assignee of this present invention and therefore will not be further described.

Figure 3:
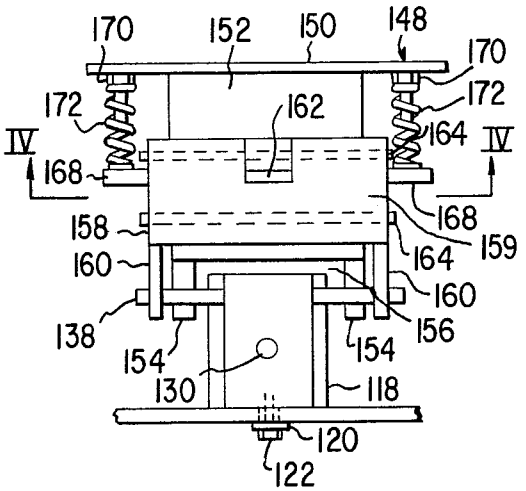
FIG. 3 is a top view of the backstop adjusting apparatus taken along the line III—III in FIG. 2 showing the manner in which the adjusting apparatus pivots a portion of the backstop means.

Referring now to FIGS. 1, 2, and 3, backstop means 26 includes an enclosure means 32 which substantially spans the width of support means 18 transverse to the direction of feed as shown in FIGS. 1 and 2. Preferably, enclosure means 32 is substantially rectangular in shape and hollow within its center. Enclosure means 32 includes a bottom 100, a back portion 98 extending perpendicular to bottom 100, and a front portion 112 extending upward perpendicular to bottom 100. Preferably, front portion 112 is substantially shorter than back portion 98. Enclosure 32 further includes a top portion 110 extending perpendicularly to back portion 98 and extending toward the direction of travel but being of shorter length than bottom 100. Enclosure means 32 further includes a pair of ends 50 and 52 closing enclosure 32. If desired, front 112, bottom 100, back 98, and top 110 may be constructed of a single sheet of material such as, for example, sheet metal, and sides 50 and 52 may be secured to the ends of enclosure 32 such as by welding. However, front 112, bottom 100, back 98, top 119 and sides 50 and 52 may be made of individual sheets of sheet metal and then secured to one another such as by welding. Top 110 includes a cut out portion 51 (FIG. 1) substantially centered between ends 50 and 52 of enclosure 32. Enclosure 32 further includes a contact plate 114 which is secured such as by welding to front portion 112 of enclosure 32 and extends the length of front 112. Preferably, contact plate 114 extends below bottom 100 to a point just above support means 18. Contact plate 114 includes a perpendicularly extending flange 115 which extends inward into the interior of enclosure 32 above the top of front 112. Contact plate 114 contacts trailing edge 28 of a bottom stack 40 of the stack of blanks 14.

Referring to FIGS. 1 and 2, enclosure means 32 further includes a pivotable portion 36 which pivots forward beyond contact plate 114 so as to prevent top blanks 38 of the stack of blanks 14 from coming in contact with bottom blanks 40 of the stack of blanks 14. By preventing top blanks 38 from coming in contact with bottom blanks 40, a portion of the weight of stack 14 is kept off bottom blank 12 to insure that suction means 24 can feed bottom blank 12 through opening 22 in gate 20 and into pull rolls 86 and 88. Pivotable portions 36 preferably includes a conventional hinge 140 secured to the top part of flange 115 of contact plate 114 such as by welding substantially centered between ends 50 and 52 so that it is in substantial alignment with cut-out portion 51 in top 110 of enclosure 32. Pivotable portion 36 preferably is constructed out of conventional sheet metal and contains a front surface 142 which is secured to hinge 140 such as by welding. Pivotable portion 36 is slanted inward to form surface 144 and slanted inward again to form surface 146. A pair of sheet metal ends 145 and 147 are secured to the ends of pivotable portion 36 such as by welding. Preferably, surface 142, 144 and 146 of pivotable portion 36 are slightly longer in the transverse direction than back 98 so that ends 146 and 147 can pivot forward and backward about hinge 40 and will overlap the outside of ends 50 and 52. When pivotable portion 36 pivots forward the trailing edges 28 of top blanks 38 will rest upon surface 144 thereby keeping top blanks 38 off bottom blanks 40.

Figure 4:
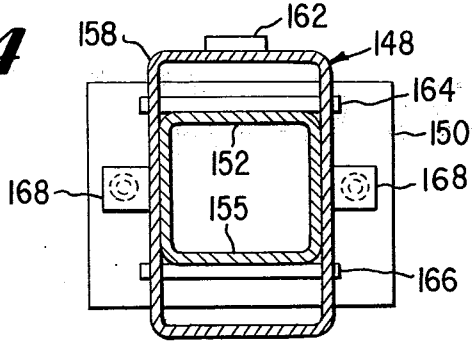
FIG. 4 is an end view in cross section of the backstop adjusting apparatus taken along the lines IV—IV of FIG. 3 showing the rectangular tube slideably supported by the rectangular sleeve and rollers.

Referring now to FIGS. 2, 3, and 4, the apparatus for pivoting pivotable portion 36 forward and backward to keep top blanks 38 off bottom blanks 40 is accomplished with a back stop adjusting apparatus 148. Backstop adjusting apparatus 148 includes a support plate 118 secured to back 98 of enclosure means 32 by a washer 120 and a bolt 122. Support plate 118 extends inward into enclosure 32 substantially the same distance as top 110 as shown in FIG. 2. Back 98 of enclosure 32 includes a vertical slot 116 through which bolt 122 passes for securing support plate 118 to back 98. When bolt 122 is loosened, support plate 118 is free to move up and down within slot 116. Support plate 118 includes a threaded opening 136 extending therethrough. In addition, support plate 118 includes a pin 138 which extends through support member 118 parallel to top 110 and bottom 100. A support member 124 is also secured to back 98 by bolt 126 and nut 128 and in vertical alignment with support plate 118. Backstop adjusting apparatus 148 further includes a threaded screw which extends through top 110 and is threaded within threaded portion 136 of support plate 118 and is rotatably secured at end 125 within support member 124. A nut 132 is secured to the top of adjusting screw 130 above top 110. Nut 132 is secured to adjusting screw 130 such as by a pin 134. Thus, when bolt 122 is loosened and nut 132 is rotated, adjusting screw 130 will cause support plate 118 to move up and down within slot 116.

Referring again to FIGS. 2, 3, and 4, backstop adjusting apparatus 148 further includes a pressure plate 150 which is secured to the back part of surface 142 of pivotable portion 36 so tat the central portion of pressure plate 150 is in substantial alignment with slot 116 in back 98 and with cut-out portion 51 on top 110. A rectangular tube 152 is secured at one end to pressure plate 150 such as by welding and extends inward into the interior of enclosure means 32. Preferably, rectangular tube 152 is made of a single sheet of sheet metal. Rectangular tube 152 extends inward into the interior of enclosure means 32 to a point spaced from the end of support plate 118. Rectangular tube 152 further includes a pair of spaced extensions 154 formed as an integral part of bottom 155. Extensions 154 are spaced along the sides of rectangular tube 152 forming a space 156 therebetween. In addition, extensions 154 are of sufficient length so they underlap pin 138 as shown in FIGS. 2 and 3. Space 156 is needed so that support plate 118 is allowed to go between extensions 154 into space 156.

Backstop adjusting apparatus 148 further includes a substantially rectangular outer sleeve 158 which surrounds rectangular tube 152. Rectangular sleeve 158 is constructed so that it is shorter than rectangular tube 152 thus allowing rectangular sleeve 158 to slide along rectangular tube 152. Rectangular sleeve 158 further includes a pair of sloped extensions 160 formed as an integral part of top 159 of rectangular sleeve 158. Extensions 160 extend beyond rectangular sleeve 158 on either side of support member 118 and overlap pin 138. Again, a space 156 is formed between sloped extensions 160 in rectangular sleeve 158. Thus, there is a pair of extensions 154 underlapping pin 138 on rectangular tube 152 and a pair of extensions 160 overlapping pin 138 on sleeve 158. Sleeve 158 further includes a pair of top rollers 164 secured to the ends of rectangular sleeve 158 such as by clips (not shown) or bearings (not shown) so that top rollers 164 are in contact with the top surface of rectangular tube 152. A pair of bottom rollers 166 are secured in a similar fashion to the sides of rectangular sleeve 158 so they are in contact with the bottom portion of rectangular tube 152. Thus, rectangular sleeve 158 can slide horizontally along rectangular tube 152. Rectangular sleeve 158 further includes a pair of side extensions 168 formed on each side thereof. A pair of bolts 170 are secured such as by welding by their heads to pressure plate 150 so that they are in substantial alignment with each side extension 168. A pair of springs 172 are placed in compression against bolt 170 and each extension 168. Thus, rectangular sleeve 158 is continually forced outward along rectangular tube 152 by spring 172. However, rectangular sleeve 158 may be moved inward along rectangular tube 152 by compressing springs 172. Preferably, rectangular sleeve 158 includes a handle 162 secured to the top thereof so that the operator of blank feeding device 10 may move rectangular sleeve 158 forward along rectangular tube 152. Thus, sleeve 158 may be moved forward compressing springs 172 until extensions 160 no longer overlap pin 138 and backstop adjusting apparatus 148 and pivotable portion 36 can be pivoted toward the interior of enclosure means 32 so that bottom stack of blanks 40 may be removed if necessary from blank feeding device 10.

Referring to FIGS. 1 and 5, backstop means 26 further includes a positioning apparatus, denoted generally by numeral 41, for automatically positioning enclosure means 32 along support means 18 in the direction of blank travel. Positioning apparatus 41 includes a pair of rack means 42 and 44 positioned within slots 82 and 84 respectively in support means 18. Each rack 42 and 44 is secured within each slot 82 and 84 such as by securing a plate 176 (FIG. 2) at each end of support means 18 such as by welding. Each plate 176 extends downward below support means 18. Each rack 42 and 44 is secured at each end to plates 176 such as by bolts 178. Each rack 42 and 44 includes a plurality of teeth 180 extending along the length thereof. Preferably, teeth 180 of each rack 42 and 44 extend slightly below the top surface of support means 18.

Positioning apparatus 41 further includes an electrically operable axle means, denoted generally by numeral 46 housed within enclosure means 32 of backstop means 26. Axle means 46 is in engagement with rack means 42 and 44 so that when axle means 46 is energized axle means 46 will propel enclosure means 32 forward and backward along racks 42 and 44 the length of support means 18. Axle means 46 includes a shaft 48 housed within enclosure means 32 and rotatably secured to ends 50 and 52 of enclosure means 32 such as in bearings 174. Shaft 48 is substantially centered between front portion 112 and back portion 98 of enclosure means 32 and is spaced substantially above bottom 100.

Axle means 46 further includes a pair of pinion gears 54 and 56 having gear teeth 182 and are rigidly secured to shaft 48 such as by keying (not shown) so they are in alignment with each rack 42 and 44. Thus, gear teeth 182 of pinion gears 54 and 56 are in meshing engagement with gear teeth 180 of racks 42 and 44 respectively.

A drive means, denoted generally by numeral 58, is connected to shaft 48 for rotating shaft 48 and consequently pinion gears 54 and 56 and propelling enclosure means 32 along racks 42 and 44. Drive means 58 is preferably secured within enclosure means 32 substantially as close to either pinion gear 54 or pinion gear 56 so it will not interfere with backstop adjusting means 148 which is located substantially within the center of enclosure means 32. Drive means 58 is mounted within enclosure means 32 as follows: a pair of rigid support means 188 are secured such as by welding to top 110 and bottom 100 of enclosure means 32. A rigid support plate 190 is secured such as by bolts 192 to support members 188. Drive means 58 is secured to plate 190 as will be further described.

Drive means 58 includes a first spur gear 60 having gear teeth 184. First spur gear 60 is rigidly secured to shaft 48 such as by keying (not shown) and spaced from pinion gear 154. A conventional gear reducer 64 is mounted to a support plate 194 in any conventional manner such as by bolts (not shown) and plate 184 is secured to plate 190 such as by bolts 196. Gear reducer 64 includes an output shaft 66 upon which is rigidly secured a second spur gear 62 with gear teeth 186. Gear reducer 64 is mounted upon plate 190 so that gear teeth 186 of second spur gear 62 is in meshing engagement with gear teeth 184 on first spur gear 60. Gear reducer 64 further includes an input shaft 70. Drive means 58 further includes a motor means 68 which is mounted upon a mounting plate 198 such as by bolts (not shown), and plate 198 is secured to plate 190 such as by bolts 200. Motor means 68 is secured to input shaft 70 of gear reducer 64. Motor means 68 includes an electrical cable 210 which is connected to an electrical connector 212 which is secured to bottom 100 of enclosure means 32 and extends downward through slot 84 in support means 18. Motor means 68 may be of any type of electrical motor that is capable of being energized and rotating gear reducer 64, thus rotating spur gears 60 and 62 and pinion gears 54 and 56 and propelling enclosure means 32 along rack means 42 and 44. It is preferred that when blank feeding device 10 is used with machinery that is not numerically controlled, that is, it is not computerized, motor means 68 be a conventional alternating current motor. However, when blank feeding machine 10 is used with machinery that is numerically controlled, it is preferred that motor means 68 be a conventional stepping motor. As will be further described, motor means 68 is electrically connected to control means 72 through electrical connector 212 located within enclosure means 32. Thus, the operator can energize backstop means 26 from control panel 72, or from a remote control panel (not shown).

Preferably, a pair of skids 74 and 76 are secured to bottom 100 of enclosure means 32 such as bolts 216, and are in sliding engagement with support means 18. Thus, enclosure means 32 is spaced above support means 18 on skids 74 and 76. In this manner, when enclosure means 32 travels along the length of support means 18, skids 74 and 76 slide along support means 18. Skids 74 and 76 may be made out of any material that has a low coefficient friction such as, for example, material having the tradename TEFLON. Backstop means 26 further includes a pair of hold down means 78 and 80 which are secured between the bottom 100 of enclosure means 32 and the bottom of racks 42 and 44 for preventing enclosure means 32 from tipping forward and backward as it travels along rack means 42 and 44 or when it contacts the trailing edge 28 of the stack of blanks 14 thus causing backward pressure on enclosure means 32. Preferably, hold down means 78 and 80 include a pair of rigid plates 218 which are secured to bottom 100 of enclosure means 32 such as by bolts 220. Plates 218 extend downward through slots 82 and 84 substantially the same as the depth of racks 42 and 44. A second plate 222 is secured to the bottom of plate 218 such as by welding perpendicular to plates 218 and extend inward beneath the bottom of racks 42 and 44 and are in sliding contact therewith. Thus, as enclosure means 32 slides along support means 18, enclosure means 32 will not tip forward or backward.

Referring now to FIG. 6, it is preferable that a conventional control panel 72 be secured to support means 18 near the rearward portion thereof to be accessible to the operator. As is illustrated in FIG. 6, backstop means 26 moves forward toward gate means 20 and backward toward control panel 72 to accommodate different blank sizes that are to be processed into the adjacent processing machinery. Since backstop means 26 is energized by electrical motor means 68 an electrical connection must interconnect control panel 72 and motor means 68 which are located within enclosure 32 of backstop means 26. Since backstop means 26 is moving forward and backward the electrical cord must be long enough to reach from control panel 72 to the maximum extension that backstop means 26 will be away from control panel 72. A problem develops when backstop means 26 is not at its full extension but is either close to control panel 72 or somewhere intermediate. In this situation excess electrical cord is lying beneath support means 18. This excess electrical cable causes a safety hazard not only to the operator who may become entangled within the electrical cord but the electrical cord may be entangled within the many moving parts associated with blank feeding machine 10. This may result in the electrical cord being broken or an electrical short may occur which may damage the machinery or may damage or injure the operator. FIG. 6 shows one method of allowing backstop means 26 to travel forward and backward along support means 18 while at the same time keeping tension upon the electrical cord and keeping it out of the way of the operator and other moving parts associated with blank feeding machine 10.

The preferred apparatus for keeping the electrical cable tensioned includes an arrangement of various pulley systems as will now be described. A cable connector 246 is connected to bottom 100 of enclosure means 32 such as by welding or bolting (not shown) and extends downward through slot 84 in support means 18. Preferably, cable connector 246 is placed in horizontal alignment with electrical connector 212 and rearward thereto. A support plate 224 is secured beneath support means 18, such as by welding, forward of the maximum position backstop means 26 moves toward gate means 20. A pulley 226 is rotatably secured in the conventional manner to support plate 224. Pulley 226 is in horizontal alignment with the end of electrical connector 212. A second support plate 228 is secured beneath support means 18 such as by welding rearward off the maximum position of backstop means 26 when it is at its most rearward point. A pulley 230 is rotatably secured to support plate 228 in the known manner, and in horizontal alignment with cable connector 246. Another support plate 232 is secured to the bottom of support means 18 such as by welding and is placed in horizontal alignment with support plate 228, and is located between support plates 228 and 224. A pair of pulleys 234 and 236 are secured to support plate 232 in the conventional manner. The top of pulley 234 is in horizontal alignment with the bottom of pulley 230. Pulley 236 is secured so that it is offset and below pulley 234. A three-sided support platform 238 which has a pair of spaced sides extending parallel to the length of support means 18 is secured to the bottom of support means 18 such as by welding and has a bottom 239 secured such as by welding between the sides of support platform 238. The ends of support platform 238 are open to allow the various cables and pulleys to extend therethrough as shown in the cut out portion of support platform 238 in FIG. 6. A pair of rotatable pulleys are freely positioned within support platform 238 on bottom 239. Pulleys 240 and 242 are free to move along bottom 239. However, pulleys 240 and 242 are rotatably interconnected between a pair of connector rods 244. Pulleys 240 and 242 are rotatably secured to connecting rods 244 in the known manner. An electrical connector 254 is rigidly secured (not shown) to any of the machinery underneath support means 18 so that electrical connector 254 is in horizontal alignment with pulley 242.

An electrical cable 256 is connected between stationary electrical connector 254 and an electrical connector 258 mounted on control panel 72. Another electrical cable 252 is connected at one end to electrical connector 212 which is secured to enclosure means 32. Electrical cable 252 is looped around pulley 226 and pulley 242 and connected at its other end to stationary connector 254. A steel cable 248 is connected at one end to cable connector 246 which is secured to enclosure means 32. Steel cable 248 is looped around pulley 230 over the top of pulley 234, around the bottom of pulley 236, looped around pulley 240, and secured to a cable connector 250 mounted on bottom 239 of support platform 238. Thus, as backstop means 26 moves forward and rearward, steel cable 248 and electrical cable 252 will always remain tight because floating pulleys 240 and 242 move along the bottom 239 on support platform 238 when backstop means 26 moves along the top of support means 18.

Although the above has described a mode of keeping the electrical cable tight while backstop means 26 moves forward and backward along support means 18 other devices may also be used instead. An alternate method would be to use a spiral electrical cable similar to that used on telephones. Thus, when backstop means 26 moves toward gate means 20, the electrical cable would stretch out and when backstop means 26 moves away from gate means 20, the cable would again coil up. A second alternative (not shown) would be to wind the electrical cable around a spring loaded cylinder connected beneath support means 18 so that the electrical cable would unwind from the cylinder as backstop means 26 moves towards gate means 20 and then would wind back around the cylinder as backstop means 26 moves away from gate means 20.

In operation and referring to FIGS. 1 and 5, when it is desired to process a stack of blanks, the operator determines the size of the blanks to be run. Preferably, there is a zero point along the support means 18 over which backstop means 26 is located. This zero point is the reference point used by the operator to determine the distance that backstop means 26 must be moved forward or rearward to accommodate the size of blanks to be run. If a non-computerized blank feeding machine 10 is used, a numerical scale may be recorded on the surface of support means 18. If however, blank feeding machine 10 is used in conjunction with machinery that is run by computer, a standard limit switch may be introduced into the circuit so that when backstop means 26 contacts the limit switch at a certain point along support means 18 this will be considered as the zero point by the computer. If the machinery is numerically controlled by a computer, the operator places the size of the blank 12 to be run in the counter window 260 located on control panel 72 or a remote control panel (not shown) by the hand wheel 264. The operator then pushes button 268 to move backstop means 26 the correct distance to accommodate the size blank 12 to be run. If the machinery is not numerically controlled, the operator pushes the start button (not shown) on control panel 72 that moves backstop means 26 in the proper direction to accommodate the size blank to be run. When backstop means 26 reaches the correct location read on the numerical scale recorded on support means 18, the operator pushes the stop button (not shown) which stops backstop means 26.

Assuming for illustration purposes only, that the machinery is numerically controlled by a computer and that backstop means 26 must be moved forward, the operator enters the correct number into window 260 by hand wheel 264 and pushes button 268. Control panel 72 then energizes motor means 168 in the correct direction which rotates input shaft 70 of gear reducer 64. This rotates output shaft 66 of gear reducer 64 which turns second spur gear 62. Since second spur gear 62 is in meshing engagement with first spur gear 60, gear reducer 64 also turns first spur gear 60. Since spur gear 60 is secured to shaft 48 which is rotatably secured to ends 50 and 52 of enclosure means 32, shaft 48 also rotates. Pinion gears 54 and 56 which are also secured to shaft 48, will rotate when shaft 48 rotates. Pinion gears 54 and 56 are in meshing engagement with gear teeth 80 of racks 42 and 44 and when they rotate they will propel enclosure means 32 forward along rack means 42 and 44. When the correct distance is reached, control panel 72 automatically de-energizes motor means 68 which stops the rotation of gear reducer 64 and consequently pinion gears 54 and 56. Thus, backstop means 26 will be positioned at the correct location. As backstop means 26 moves forward, it moves forward along skids 74 and 76 which slide along the top surface of support means 18. In addition, enclosure means 32 is prevented from tipping forward or backward as it moves along support means 18 by hold down means 78 and 80 which slides along the bottom of rack means 42 and 44.

Referring now to FIGS. 1, 2, and 3, once backstop means 26 is in the correct position to accommodate a stack of blanks 14, the operator obtains a bottom stack 40 of blanks substantially the same height as contact plate 114 which is secured to front portion 112 of enclosure means 32 and places it on support means 18. The operator takes the upper stack 38 of the stack of blanks 14 and places them on top of bottom stack of blanks 40 so that leading edge 30 of top blanks 38 are in engagement with gate means 20. If top blanks 38 fall upon the top of bottom blanks 40, the operator must adjust backstop adjusting apparatus 148 to pivot pivotable portion 36 forward. To do this, the operator loosens bolt 122 on back 98 of enclosure means 32. This loosens support plate 118. The operator places a wrench on nut 132 which is secured to adjusting screw 130 and rotates adjusting screw 130 in the direction that will raise support plate 118 upward in slot 116. By raising support plate 118 this lifts the back part of backstop adjusting apparatus 148 tilting the pivotable portion 36 forward. The operator continues rotating adjusting screw 130 until trailing edges 28 of top stack of blanks 38 engage surface 144 on pivotable portion 36. When the operator has obtained the correct angle, he tightens nut 122 securing support plate 118 against back 98 of enclosure means 32.

The operator places top stack of blanks 38 on bottom blanks 40 so that leading edge 30 of top blanks 38 is resting on the top blank of bottom stack of blanks 40 and against gate means 20 while trailing edge 28 of top blanks 38 is resting above the stack of bottom blanks 40 on surface 144 of pivotable portion 36. In this manner, the weight of top stack of blanks 38 is removable from bottom blanks 40. Thus, less weight will be placed upon bottom blank 12. When it is desired to feed bottom blank 12 between pull rolls 86 and 88, the operator activates the reciprocating suction feeder means 24 in the manner previously described. Suction pressure is applied to bottom blank 12 by suction box 92 through suction openings 94. Suction box 92 then reciprocates forward propelling bottom blank 12 through opening 22 between support means 18 and gate means 20 and into space 87 between pull rolls 86 and 88. As pull rolls 86 and 88 grip bottom blank 12 suction pressure is released from suction box 92 in the known manner thus relieving suction pressure applied to bottom blank 12. Bottom blank 12 is pulled into the adjacent processing machine by pull rolls 86 and 88. When the trailing edge of bottom blank 12 exits past gate means 20 bottom stack 40 falls the distance of bottom blank 12 onto the top surface of support means 18. When this occurs a bottom blank 272 of top stack 38 also falls the distance of one blank width. When it falls this distance, it encounters slanted surface 90 on gate means 20 and moves forward a slight amount along slanted surface 90. When bottom blank 272 contacts slanted surface 90, trailing edge 28 of bottom blank 272 becomes disengaged from surface 144 of pivotable section 36 and falls upon bottom stack 40. This process continues until all blanks within the stack of blanks 14 have been fed through opening 22 in gate means 20 and into the adjacent processing machinery 16.

Should the operator desire to remove botttom stack 40 from support means 18 he must pivot pivotable portion 36 out of the way to lift bottom stack 40 straight up. To do this the operator takes hold of handle 162 on rectangular sleeve 158 and pulls rectangular sleeve 158 forward compressing springs 172. When the rear extensions 160 on rectangular sleeve 158 disengages pin 138 on support plate 118, the operator pivots pivotable portion 36 and backstop adjusting apparatus 148 rearward. The operator can then remove bottom stack 40 without interferring with pivotable portion 36. After bottom stack 40 is removed, the operator lifts backstop adjusting apparatus 148 upward along the sloped surface of extensions 160 on rectangular sleeve 158 until extensions 160 engage the top portion of pin 138.

When a different size of blanks are to be run, the machine operator enters the size of the new blanks to be run into window 260 of control panel 72 and then repeats the above process.

The foregoing has presented a novel blank feeding machine for feeding a stack of blanks into adjacent processing machinery. The problem associated with a reciprocating kicker bar engaging the trailing edge of the bottommost blank has been eliminated by the use of a reciprocating suction feeder thus eliminating the need for any kicker bar. The problem of having too much weight on the buttommost blank has been eliminated by having the backstop assembly contain a pivotable portion which keeps a portion of the weight of the stack of blanks raised above the bottom portion of the stack thus preventing the whole weight of the stack from resting on the bottom blank. In addition, the problem of manually moving the backstop assembly along the support means to accommodate different size stacks has been eliminated by making the backstop means automatically positionable along the length of the support means by the operator remaining at the control panel.

Accordingly, the invention having been described in its best embodiment and mode of operation, that which is desired to be claimed by Letters Patent is:

1. A remotely operable backstop means selectively positionable along the length of a feed table of a blank feeding device for accommodating different size stacks of blanks thereon, comprising:

a pair of laterally spaced rack means secured to said feed table and extending along the length thereof parallel to the direction of feed of said blanks;

an enclosure means extending across and spaced above said rack means transverse to the direction of feed;

a shaft means housed within said enclosure means and rotatably secured to transverse ends of said enclosure means;

a pair of pinion gear means secured to said shaft means, each of said pinion gear means in meshing engagement with one of said rack means; and a remotely operable electrical drive means housed within said enclosure means and connected to said shaft means for rotation thereof upon energization of said drive means for moving said backstop means along said rack means on said feed table, said enclosure means further including a manually adjustable, pivotably movable, stack support means along the lateral center thereof for resiliently-biased engagement with a bottom blank of an upper portion of said stack.

2. The backstop means of claim 1 wherein said drive means includes:

a first spur gear secured to said shaft means for rotation therewith;

a second spur gear in meshing engagement with said first spur gear;

a gear reducer means having an output portion connected to said second spur gear; and an electrical motor means connected to an input portion of said gear reducer means for imparting rotary motion to said pinion gear means to move said backstop means along said rack means.

3. The backstop means of claim 2 wherein said electrical motor means is an alternating current motor.

4. The backstop means of claim 2 wherein said electrical motor means is a stepping motor.

5. An improved blank feeding device for feeding successive bottom blanks from a stack of blanks into adjacent processing machinery of the type comprising support means for supporting said stack of blanks thereon;

gate means spaced above said support means defining an opening therebetween through which said bottom blanks are advanced into said adjacent processing machinery;

reciprocable suction feed means operatively associated with said support means beneath said stack for applying suction pressure to said successive bottom blanks during a forward stroke thereof for advancing said bottom blanks through said opening; and an adjustable backstop means in contact with the trailing edge of said blanks;

wherein the improvement comprises;

said backstop means having a manually adjustable portion movable into contact with an upper portion of said stack for keeping the weight of said upper portion substantially off said successive bottom blanks, said backstop means including an enclosure means spanning the width of said support means transverse to the direction of feed, said enclosure means having a leading edge portion which constitutes part of said manually adjustable portion for contacting said trailing edge of said upper portion of said stack, said leading edge being pivotable toward said stack to maintain the trailing edges of said upper portion of said stack spaced from the trailing edges of the bottom blanks of said stack, said backstop means including a remotely operable drive means associated therewith for selective positioning of said backstop means into engagement with the trailing edge of said stack of blanks, said drive means enclosed by said enclosure means.

6. A blank feeding device as in claim 5 wherein said support means includes a pair of laterally spaced rack means secured thereto extending parallel to the direction of feed and wherein said drive means includes:

a shaft means housed within said enclosure means and rotatably secured to the transverse ends of said enclosure means for rotation thereof upon energizing said drive means; and a pair of pinion gear means secured to said shaft means, each of said pinion gear means in meshing engagement with one of said rack means.

7. A blank feeding device as in claim 6 wherein said drive means further includes a first spur gear rigidly connected to said shaft means;

a second spur gear in meshing engagement with said first spur gear;

a gear reducer means having an output portion connected to said second spur gear; and an electric motor means connected to an input portion of said gear reducer means for rotating said pinion gear means to move said backstop means along said rack means on said support means.

8. A blank feeding device as in claim 7 further including a control means for energizing said motor means when different size stacks of said blanks are to be placed upon said support means.

9. A blank feeding device as in claim 8 wherein said enclosure means further includes a skid means attached to the underside of said enclosure means and in sliding engagement with said support means for stabilizing said backstop means on said support means.

10. A blank feeding device as in claim 9 wherein said enclosure means further includes a hold down means rigidly connected to said enclosure means and slideably secured to said rack means to prevent said backstop means from tipping forward or backward as said backstop means moves along said rack means on said support means.

11. A blank feeding device as in claim 8 wherein said enclosure means further includes a hold down means rigidly connected to said enclosure means and slideably secured to said rack means to prevent said backstop means from tipping forward or backward as said backstop means moves along said rack means on said support means.

* * * * *